US007919179B2

(12) United States Patent
Furusawa et al.

(10) Patent No.: US 7,919,179 B2
(45) Date of Patent: Apr. 5, 2011

(54) RESIN-COATED SAND FOR MULTILAYER MOLD

(75) Inventors: Hiroshi Furusawa, Aichi (JP); Masanori Totsuka, Wako (JP); Naohisa Shibata, Wako (JP)

(73) Assignees: Asahi Organic Chemicals Industry Co., Ltd., Nobeoka-Shi (JP); Honda Motor Co., Ltd., Minato-Ku (JP)

( * ) Notice: Subject to any disclaimer, the term of this patent is extended or adjusted under 35 U.S.C. 154(b) by 769 days.

(21) Appl. No.: 11/837,580

(22) Filed: Aug. 13, 2007

(65) Prior Publication Data

US 2008/0021133 A1 Jan. 24, 2008

Related U.S. Application Data

(63) Continuation of application No. PCT/JP2006/302661, filed on Feb. 15, 2006.

(30) Foreign Application Priority Data

Feb. 16, 2005 (JP) ..... 2005-039010
Nov. 11, 2005 (JP) ..... 2005-327245

(51) Int. Cl.
*B32B 29/00* (2006.01)

(52) U.S. Cl. ..... 428/323; 428/331; 428/403; 428/404; 428/405; 428/406; 428/407; 523/139; 523/145; 523/201

(58) Field of Classification Search ..... 428/323, 428/331, 403–407; 523/139, 145, 201, 1
See application file for complete search history.

(56) References Cited

U.S. PATENT DOCUMENTS

| | | | | |
|---|---|---|---|---|
| 3,962,491 | A | 6/1976 | Sato et al. | |
| 4,094,834 | A | 6/1978 | Bowers et al. | |
| RE31,767 | E | 12/1984 | Brooks | |
| 5,132,143 | A | 7/1992 | Deckard | |
| 6,155,331 | A | 12/2000 | Langer et al. | |
| 6,335,097 | B1 | 1/2002 | Otsuka et al. | |
| 7,579,075 | B2 * | 8/2009 | Furusawa | 428/323 |

FOREIGN PATENT DOCUMENTS

| | | | |
|---|---|---|---|
| EP | 0 287 657 | B2 | 8/1999 |
| EP | 0 972 628 | A1 | 1/2000 |
| JP | 60-184446 | A1 | 9/1985 |
| JP | 2620353 | B2 | 6/1997 |
| JP | 11-197787 | A1 | 7/1999 |
| JP | 2000-024750 | A1 | 1/2000 |
| JP | 2004-090009 | A1 | 3/2004 |
| JP | 2005-169434 | A1 | 6/2005 |

* cited by examiner

*Primary Examiner* — Leszek Kiliman
(74) *Attorney, Agent, or Firm* — Burr & Brown

(57) ABSTRACT

To provide resin-coated sand for a multilayer mold in which the consolidation strength of the casting mold obtained by using it and gas permeability thereof are improved at the same time, the amount of occurrence of pyrolytic products (tar, soot and the like) derived from organic substances is effectively inhibited, when molding is performed using such a casting mold, and further, the casting mold after molding can exhibit excellent collapsibility. Disclosed is resin-coated sand for a multilayer mold, in which surfaces of refractory particles are coated with a binder composition containing a phenolic novolak resin having an ortho/para bond ratio of methylene groups of 1.5 or more and an aromatic amine as indispensable constituents, and the grain fineness number is from 80 to 150.

10 Claims, No Drawings

RESIN-COATED SAND FOR MULTILAYER MOLD

This application is a continuation of the International Application No. PCT/JP2006/302661, filed Feb. 15, 2006, which claims the benefit under 35 U.S.C. §119(a)-(d) of Japanese Application 2005-39010, filed Feb. 16, 2005, the entireties of which are incorporated herein by reference.

TECHNICAL FIELD

The present invention relates to resin-coated sand which can be suitably used when a casting mold is manufactured according to a multilayer molding process, i.e., resin-coated sand for a multilayer mold (hereinafter also abbreviated to RCS for a multilayer mold).

BACKGROUND ART

Previously, when a casting mold (a main mold and a core) used in sand casting is manufactured by way of trial, a molding tool such as a wooden mold, a resin mold or a metallic mold having a reverse structure of a target casting mold has been first designed and manufactured, and then, a trial product of the casting mold has been manufactured using the molding tool. However, it requires much time, professional knowledge, technical skill and the like for designing and manufacturing the wooden mold and the like having such a reverse structure. For this reason, as a new technique used in place of such a conventional process for manufacturing the mold (by way of trial), attention has recently been attracted to a so-called multilayer molding process.

Such a multilayer molding process is a molding process as proposed in patent document 1 (U.S. Pat. No. 5,132,143), and specifically, a technique of directing a laser beam to a sinterable powder scattered in the form of a laminae (first layer) in order to selectively sinter only a necessary portion therein, successively scattering the sinterable powder on the first layer to form a second layer, also directing the laser beam to such a second layer in the same manner as the above in order to selectively sinter only a necessary portion, joining a sintered portion of the second layer and a sintered portion of the first layer sintered by previous beam irradiation, and repeating this process necessary times, thereby multilayering layer by layer to mold a casting mold having a target three-dimensional form.

As the sinterable powder used herein in such a multilayer molding process, there is generally used resin-coated sand similar to that used in shell molding, which comprises refractory particles surfaces which are coated with a resin composition (binder composition). However, such resin-coated sand is required to have properties beyond those of the resin-coated sand used in the shell molding, so that there is employed the resin-coated sand particularly specialized to the multilayer molding process (RCS for a multilayer mold).

As such RCS for a multilayer mold, various ones have conventionally been used. For example, patent document 2 (U.S. Pat. No. 6,335,097) proposes almost-spherical sand particles having a particle diameter of 20 to 100 μm which are coated with resin. It is disclosed that the RCS for a multilayer mold (resin-coated sand for a multilayer mold) is fine particles which have less uneven surfaces and can secure good sand scattering properties, thereby dimensional accuracy of the resulting casting mold can be advantageously secured even when the thickness of a sand layer is as extremely thin as about 0.1 to 0.2 mm.

Further, patent document 2 also discloses that, with respect to the RCS for a multilayer mold (resin-coated sand for a multilayer mold) proposed therein, the resin on the surfaces preferably has a fusion temperature of 100° C. or higher, in order to secure dimensional accuracy of the resulting casting mold, and that the sand particles used therein are preferably mullite-based sand particles, in order to prevent thermal expansion of the sand particles caused by laser beam irradiation and secure dimensional accuracy of the casting mold, and also preventing strain, core cracking and the like caused by thermal deformation at the time when molding is performed using the resulting casting mold. Furthermore, as a specific example in producing the RCS for a multilayer mold (resin-coated sand for a multilayer mold), it is disclosed that a phenolic novolak resin having an average molecular weight of about 2,000 to 10,000 and a fusion temperature of 100° C. or higher is added in an amount of 3 to 5 parts by weight based on 100 parts by weight of sand particles. In addition, patent document 2 also discloses that the multilayer mold manufactured using the RCS for a multilayer mold (resin-coated sand for a multilayer mold) is provided with a vent hole, in order to prevent gas defects caused by pyrolytic products derived from organic substances such as the phenol resin, for example, tar, soot and the like, when molding is performed using the casting mold.

However, in patent document 1 and patent document 2 as described above, only fundamental technical items with respect to the multilayer molding process and the resin-coated sand for a multilayer mold used therein are disclosed. Further, these patent documents point out problems that the resin-coated sand for a multilayer mold is to solve, specifically a problem of sand breaking properties on a boundary face between the multilayer mold which is a solidified layer region and a non-solidified layer region, a problem of gas permeability in the resulting casting mold, and the like, in the casting mold (multilayer mold) in which the strength of the solidified layer (hereinafter referred to as the consolidation strength) is developed by irradiation of a laser beam to such a degree that a subsequent sand scattering operation is performed without trouble, and such solidified layers are sequentially multilayered. However, against such problems, an attempt to improve the RCS for a multilayer mold, specifically, an attempt from the viewpoints of the phenolic novolak resin used in the binder composition which coats a surface of the sand and the sand particle size of the resin-coated sand, is not disclosed at all nor suggested.

Patent Document 1: U.S. Pat. No. 5,132,143

Patent Document 2: U.S. Pat. No. 6,335,097

DISCLOSURE OF THE INVENTION

Problems to be Solved by the Invention

The present invention has been made in the light of the above-mentioned situations. It is therefore an object of the invention to provide resin-coated sand for a multilayer mold which simultaneously improve the consolidation strength and the gas permeability of the multilayer mold obtained by using it, and effectively restrain the amount of occurrence of pyrolytic products (tar, soot and the like) derived from organic substances, when molding is performed using such a multilayer mold, and further, the casting mold after molding can exhibit excellent collapsibility.

Means for Solving the Problems

The present inventors have made intensive studies on resin-coated sand for a multilayer mold. As a result, they have found that the above-mentioned object can be advantageously achieved by resin-coated sand for a multilayer mold which has a composition containing a specific phenolic novolak resin and aromatic amine as indispensable constituents used as a binder composition and surfaces of refractory particles are coated with such binder composition and which has a specific particle size, thus, the present invention has been completed.

That is to say, an object of the present invention is resin-coated sand for a multilayer mold comprising refractory particles surfaces which are coated with a binder composition, wherein the binder composition comprises a phenolic novolak resin having an ortho/para bond ratio of methylene groups of 1.5 or more and an aromatic amine as indispensable constituents, and the grain fineness number thereof is from 80 to 150.

In one preferred embodiment of such resin-coated sand for a multilayer mold according to the present invention, the above-mentioned binder composition further comprises an alkali metal salt of an oxo acid.

Further, in another preferred embodiment of the resin-coated sand for a multilayer mold according to the present invention, the above-mentioned aromatic amine is 1,3-bis(3-aminophenoxy)benzene.

Still further, in still another preferred embodiment of the resin-coated sand for a multilayer mold according to the present invention, the above-mentioned refractory particles are selected from the group consisting of Unimin sand, Wedron sand, zircon sand, chromite sand, spherical alumina sand, spherical ferronickel-based slag, ferrochromium-based spherical slag, a recycled material or reclaimed material thereof, and a mixture thereof.

Yet still further, in another preferred embodiment of the resin-coated sand for a multilayer mold according to the present invention, the above-mentioned phenolic novolak resin is used at a ratio of 2 to 5 parts by mass based on 100 parts by mass of the above-mentioned refractory particles.

Furthermore, in one desirable embodiment of the resin-coated sand for a multilayer mold according to the present invention, the above-mentioned aromatic amine is used at a ratio of 1 to 20 parts by mass based on 100 parts by mass of the phenolic novolak resin.

Still furthermore, in another desirable embodiment of the resin-coated sand for a multilayer mold according to the present invention, the above-mentioned alkali metal salt of an oxo acid is used at a ratio of 1 to 50 parts by mass based on 100 parts by mass of the phenolic novolak resin.

Yet still furthermore, in still another desirable embodiment of the resin-coated sand for a multilayer mold according to the present invention, the above-mentioned phenolic novolak resin is one produced by reacting an aldehyde (F) with a phenol (P) at a blending molar ratio (F/P) of the aldehyde to the phenol of 0.55 to 0.80.

Moreover, in another desirable embodiment of the resin-coated sand for a multilayer mold according to the present invention, the above-mentioned phenolic novolak resin is one obtained by reacting a phenol and an aldehyde using a divalent metal salt catalyst.

Still moreover, in still another desirable embodiment of the resin-coated sand for a multilayer mold according to the present invention, the above-mentioned phenolic novolak resin has a number average molecular weight of 400 to 1,000.

Advantageous Effect of the Invention

In the resin-coated sand for a multilayer mold according to the present invention, as a binder composition to coat a surface thereof, there is used one comprising a phenolic novolak resin having an ortho/para bond ratio of methylene groups of 1.5 or more and an aromatic amine as indispensable constituents, and the particle size represented by the grain fineness number is regulated in a specific range. Accordingly, when a casting mold is molded using such resin-coated sand for a multilayer mold according to a conventional multilayer molding process, the resulting multilayer mold can exhibit excellent consolidation strength and gas permeability. In particular, in the resin-coated sand for a multilayer mold in which 1,3-bis(3-aminophenoxy)benzene is used as the aromatic amine contained in the binder composition, the multilayer mold obtained using the same can exhibit more excellent consolidation strength.

Further, in the binder composition, the use of the specific phenolic novolak resin described above advantageously improves and stabilizes consolidation strength, so that the incorporation amount of the binder composition to the refractory particles can be reduced compared to the conventional resin-coated sand for a multilayer mold. In the resulting multilayer mold, therefore, the occurrence of gas defects and the like which are caused by pyrolytic products derived from organic substances such as the phenol resin is effectively prevented, and further, collapsibility after used in molding is improved.

Moreover, in the resin-coated sand for a multilayer mold which employs the binder composition containing the alkali metal salt of an oxo acid in addition to the above-mentioned specific phenolic novolak resin, when molding is performed using the multilayer mold comprising such resin-coated sand, subsequent collapse of the multilayer mold becomes easier, and sand removing workability will be improved.

BEST MODE FOR CARRYING OUT THE INVENTION

The resin-coated sand for a multilayer mold according to the present invention comprises refractory particles surfaces of which are coated with a binder composition comprising a phenolic novolak resin having an ortho/para bond ratio of methylene groups of 1.5 or more and an aromatic amine as indispensable constituents, as described above.

Such a phenolic novolak resin develops the thermosetting property by laser beam irradiation or heating in the presence or absence of a curing agent, and the refractory particles are bonded (to be firmly fixed or cured) to one another, thereby developing strength in the resulting cured product (casting mold). In the present invention, of such phenolic novolak resins, the phenolic novolak resin having an ortho/para bond ratio of methylene groups of 1.5 or more is used, and more preferably, the phenolic novolak resin having an ortho/para bond ratio of methylene groups of 2.0 or more is used. When such an ortho/para bond ratio is less than 1.5, there is a fear of failing in improvement of consolidation strength in the resulting cured product (casting mold). Accordingly, the binder composition is obliged to be used in large amounts. As a result, when molding is performed using the resulting casting mold, there is a fear that generation of pyrolytic products caused by organic substances such as the phenol resin is increased.

The ortho/para bond ratio of methylene groups in the phenolic novolak resin mentioned herein is the ratio of methylene groups whose bond position with respect to the phenolic hydroxyl group in the foregoing resin is the ortho position to methylene groups whose bond position is the para position, that is to say, the ratio of the number of methylene groups bonded at the ortho position to the number of methylene groups bonded at the para position. The ortho/para bond ratio in this description and claims is measured (calculated) by the $^{13}$C-NMR spectroscopy.

Specifically, a value derived from the following equation 1 is the ortho/para bond ratio.

$$[\text{Ortho/para bond ratio}]=(a+b/2)/(c+b/2) \quad \text{equation 1}$$

where integrated values of the absorption bands for the respective ortho-ortho bond, ortho-para bond and para-para bond in the phenolic novolak resin are a, b and c, respectively. Although the chemical shift values shift depending on the substituent group, they are generally in the order of a, b and c from small to large.

Such an ortho/para bond ratio is practically substituted by the ratio of the ortho-ortho bond, ortho-para bond and para-para bond of a binuclear component in the resin in many cases, which is measured by an area method of gel permeation chromatography. The phenolic novolak resin preferably showing an ortho/para bond ratio, in terms of standard polystyrene, of 2.5 or more, more preferably 5.0 or more is advantageously used in the present invention, when measured according to such a technique, specifically using a gel permeation chromatograph, SC-8010: manufactured by TOSOH CORPORATION (column: G1000H$_{XL}$+G2000H$_{XL}$, detector: UV 254 nm, carrier: tetrahydrofuran 1 mm/min, column temperature: 38° C.).

As the phenolic novolak resin used in the present invention, any one can be used as long as it has an ortho/para bond ratio of 1.5 or more. Specific examples thereof include a low expansive phenolic novolak resin obtained by reacting bisphenol A with a low expansive component such as a purification residue in the production of bisphenol A with an aldehyde under the coexistence of phenol, as disclosed in JP-A-57-68240, and other low expansive phenolic novolak resins, in addition to general phenolic novolak resins. Further, there can also be used various modified phenolic novolak resins obtained by reacting or mixing these respective resins with any compound, for example, an epoxy resin, a melamine resin, a urea resin, a xylene resin, a vinyl acetate resin, a polyamide resin, a melamine-based compound, a urea compound, an epoxy-based compound, cashew nut shell oil or the like, during the production of the above-mentioned respective phenolic novolak resins or after the production thereof.

Examples of the phenols used as one of the starting materials in the production of the phenolic novolak resin include alkyl phenols such as phenol, cresol and xylenol, bisphenols such as bisphenol A and bisphenol F, phenol-based purification residues such as a purification residue at the production of bisphenol A, and the like. Further, as examples of the aldehydes which is another starting material, there can be used formaldehyde, formalin, paraformaldehyde, trioxan, acetic aldehyde, paraldehyde, propionaldehyde and the like. The phenols and the aldehydes should not be limited to those exemplified herein, and it is also possible, of course, to use ones other than these. Further, any one of, or any combination of the starting materials can be used.

Further, the blending molar ratio of the aldehyde and the phenol in the production of the phenolic novolak resin is set preferably within the range of 0.55 to 0.80, and more preferably within the range of 0.63 to 0.75. When the blending molar ratio is 0.55 or more, the phenolic novolak resin is obtained in sufficient yield. Conversely, when the blending molar ration is 0.80 or less, there is obtained a improved strength of the casting mold obtained by shaping the RCS for a multilayer mold using the resulting phenolic novolak resin.

Furthermore, a production method of the phenolic novolak resin used in the present invention is not particularly limited, and various conventionally known techniques can be employed. Of these techniques, a technique of reacting the phenol with the aldehyde by using a divalent metal salt catalyst as an acid catalyst is advantageously employed, so that the phenolic novolak resin can be obtained effectively. As the divalent metal salt catalyst used therein, there is advantageously used zinc oxide, zinc chloride, zinc acetate, magnesium oxide or the like, so that the ortho/para bond ratio of methylene groups in the resulting phenolic novolak resin can be adjusted to 1.5 or more. However, it is also possible to use ones other than the above.

The phenolic novolak resin thus obtained shows a solid state or a liquid state (for example, a resin solution, a varnish, an emulsion or the like), and develops the thermosetting property, for example, by heating in the presence or absence of a curing agent or a curing catalyst such as hexamethylenetetramine or a peroxide. In the present invention, there is suitably used the phenolic novolak resin having a number average molecular weight preferably within the range of 400 to 1000, more preferably within the range of 500 to 700. When the phenolic novolak resin having a number average molecular weight of less than 400 is used, there is a fear of deteriorating sand breaking properties of the resin-coated sand. On the other hand, when the phenolic novolak resin having a number average molecular weight of more than 1000 is used, substantial improvement in consolidation strength cannot be expected.

On the other hand, in the resin-coated sand for a multilayer mold of the present invention, the binder composition which coats the surface of the resin-coated sand comprises the aromatic amine as the indispensable constituent, together with the specific phenolic novolak resin as described above. In the resin-coated sand (RCS) for a multilayer mold comprising refractory particles surfaces which are coated with the binder composition containing the aromatic amine as described above, if the multilayer mold is produced by the multilayer molding process using the same, there is dramatically improved handling properties, when the RCS layers (multilayer mold) sintered by irradiation of a laser beam are taken out from a non-irradiated site with such a beam in producing process of the casting mold, and the resulting casting mold exhibits excellent consolidation strength.

Here, as the aromatic amine used in the present invention, any one can be used as long as it is conventionally known. Specific examples thereof include aromatic monoamine compounds such as o-aminobenzoic acid (melting point: 145° C.), o-aminoanthracene (melting point: 130° C.), triphenylamine (melting point: 127° C.) and naphthylamine (melting point: 113° C.), aromatic diamine compounds such as 1,3-bis(3-amino-phenoxy)benzene (melting point: 109° C.), 4,4-bis(4-dimethylamino) diphenylmethane (melting point: 89° C.), ortho-phenylenediamine (melting point: 103° C.), metaphenylenediamine (melting point: 62° C.) and 4,4'-diaminodiphenylmethane (melting point: 91° C.), and the like. Of these, 1,3-bis(3-aminophenoxy) benzene and 4,4'-diaminodiphenylmethane are advantageously used, so that the resulting multilayer mold exhibits more excellent consolidation strength. Any one of, or any combination of these aromatic amines can be used.

As for the amount of such an aromatic amine incorporated, the amine is incorporated preferably at a ratio of 1 to 20 parts by mass, and more preferably at a ratio of 3 to 10 parts by mass, based on 100 parts by mass of the phenolic novolak resin. When the amount incorporated is less than 1 part by mass, there is a fear of failing to obtain sufficient consolidation strength. On the other hand, exceeding 20 parts by mass results in failure to obtain the effect of improving consolidation strength by incorporation. Accordingly, from the viewpoint of cost effectiveness, the addition of the aromatic amine in an amount of 20 parts by mass or more is uneconomical.

It is also possible to add the aromatic amine together with the phenolic novolak resin when the resin-coated sand for a multilayer mold is produced. However, it is preferred that the aromatic amine is previously melt-mixed with the phenolic novolak resin before the production of the resin-coated sand.

Further, in the present invention, in addition to the above-mentioned phenolic novolak resin and aromatic amine, the alkali metal salt of an oxo acid further can be incorporated into the binder composition, so that collapsibility of the multilayer mold after molding will be improved.

As examples of the alkali metal salts of an oxo acid, there can be used alkali metal salts of nitric acid such as sodium nitrate and potassium nitrate, alkali metal salts of permanganic acid such as potassium permanganate, alkali metal salts of molybdic acid such as sodium molybdate, alkali metal salts of tungstic acid such as sodium tungstate, and the like. Of these, the alkali metal salts of nitric acid, the alkali metal salts of molybdic acid and the alkali metal salts of tungstic acid which have a small deterioration in consolidation strength are preferable. In particular, the alkali metal salts of nitric acid are preferable, and especially, potassium nitrate is preferable from the viewpoint of cost and the like. Any one of, or any combination of these alkali metal salts of an oxo acid can be used.

As for the amount of the alkali metal salt of an oxo acid incorporated in the present invention, the alkali metal salt is incorporated at a ratio of 1 to 50 parts by mass, and preferably at a ratio of 3 to 20 parts by mass, based on 100 parts by mass of the phenolic novolak resin. When the amount incorporated is less than 1 part by mass, there is a fear of failing to improve collapsibility of the casting mold. On the other hand, exceeding 50 parts by mass causes a fear of excessively weak consolidation strength. Further, such an alkali metal salt of an oxo acid can also be melt-mixed with the phenolic novolak resin previous to the production of the resin-coated sand for a multilayer mold. However, it is preferably added during the production of the resin-coated sand.

Then, the resin-coated sand for a multilayer mold according to the present invention is produced by coating the surfaces of the refractory particles with the binder composition comprising the components as described above, according to various known techniques, preferably the hot marling method. Specifically, according to the hot marling method, the pre-heated refractory particles are first placed in a speed mixer, and then, the phenolic novolak resin in which the aromatic amine is previously melt-mixed, the alkali metal salt of an oxo acid as needed and further other arbitrary additives are incorporated, followed by kneading. Thereafter, there is added an aqueous solution which comprises a curing agent such as hexamethylenetetramine dissolved in cooled water, and air blast cooling is performed at the same time. Finally, a lubricant such as calcium stearate is added and mixed, thereby obtaining the resin-coated sand for a multilayer mold of the present invention.

The resin-coated sand for a multilayer mold thus obtained is adjusted so as to have the grain fineness number within the rang of 80 to 150, and preferably within the range of 90 to 130, in the AFS coefficient standard specified by the JACT test method S-1 (the particle size test method of casting sand), with reference to gas permeability and sand scattering properties of the resulting casting mold, the thickness of the sand layers at the time when the casting mold is shaped using the sand, and the like. When the grain fineness number is less than 80, there is a fear of failing to obtain sufficient consolidation strength. On the other hand, exceeding 150 causes a fear of deteriorating gas permeability of the resulting casting mold. As described above, the resin-coated sand for a multilayer mold of the present invention can be advantageously produced according to the hot marling method. However, it is also possible to employ methods other than the hot marling method, for example, the semi-hot marling method and the cold marling method, as long as sand scattering properties can be secured practically without trouble.

When such a resin-coated sand for a multilayer mold of the present invention is produced, the phenolic novolak resin is incorporated at a ratio of 2 to 5 parts by mass, and preferably at a ratio of 2.5 to 3.8 parts by mass, based on 100 parts by mass of the refractory particles. When the incorporation amount thereof is less than 2 parts by mass, there is a fear of failing to improve consolidation strength. On the other hand, exceeding 5 parts by mass causes a fear of deteriorating collapsibility of the resulting casting mold.

Further, as the refractory particles used in the present invention, there is advantageously used one which has a grain fineness number within the range of 80 to 150 in the AFS coefficient standard from the viewpoint of sand scattering properties, preferably within the range of 90 to 130, in consideration of gas permeability of the resulting casting mold. In addition, the refractory particles of almost perfect sphere, and further has a low coefficient of thermal expansion in order to retain dimensional accuracy of the resulting casting mold and inhibit the occurrence of strains and cracks caused by thermal deformation during molding.

Example of the refractory particles include, Unimin sand, Wedron sand, zircon sand, chromite sand, Cerabeads (trade name, manufactured by Itochu Ceratech Corporation. spherical alumina sand), Greenbeads (trade name, distribution source: KINSEI MATEC CO., LTD., spherical alumina sand), Sunpearl (trade name, manufactured by Yamakawa Sangyo Co., Ltd., spherical ferronickel-based slag), ferrochromium-based spherical slag, a recycled material or reclaimed material thereof, and a mixture thereof. Of these, artificial spherical sand such as Cerabeads is particularly preferred from the viewpoints of sand scattering properties and dimensional accuracy of the resulting casting mold. Any one of, or any combination of these refractory particles can be used.

EXAMPLES

To further clarify the present invention, there will be described some examples of the present invention. It is to be understood that the present invention is not limited to the details of the following examples. In addition to the following examples and further the above-mentioned specific descriptions, it is to be understood that various changes, modifications and improvements may be made to the present invention, based on knowledge of those skilled in the art without departing from the scope of the present invention. The characteristic (ortho/para bond ratio) of the phenolic novolak resin used in the production of the resin-coated sand for a multilayer mold and the characteristics of the produced resin-coated sand for a multilayer mold were measured according to the following test methods.

—Ortho/Para Bond Ratio of Methylene Groups in Phenolic Novolak Resin—

$^{13}$C-NMR (100 MHz, solvent: heavy methanol-d4) of each resin was measured using a nuclear magnetic resonance apparatus (manufactured by Varian Inc. INOVA 400), and the ortho/para bond ratio of methylene groups in the phenolic novolak resin was calculated from the following equation:

$$[\text{Ortho/para bond ratio}]=(a+b/2)/(c+b/2)$$

a: An integrated value of the methylene absorption band (30.4 to 32.4 ppm) for the ortho-ortho bond b: An integrated value of the methylene absorption band (35.2 to 36.8 ppm) for the ortho-para bond c: An integrated value of the methylene absorption band (40.4 to 42.0 ppm) for the para-para bond —Grain fineness number of RCS for Multilayer Mold—

The grain fineness number was determined by the provisions of the JACT test method S-1 (the particle size test method of casting sand). That is to say, it was determined according to "the particle size test method of casting sand" specified in JIS Z 2601-1993, appendix 2.

—Fusion Temperature of RCS for Multilayer Mold—

The fusion temperature was measured based on the JACT test method C-1 (the fusion point test method). Specifically, a coated sand melting point measuring device S-200 manufactured by Takachiho Seiki Co., Ltd. is used as fusion point measuring device, and RCS to be measured is quickly scattered on a metal rod thereof (sample thickness: about 4 mm) which is allowed to have a temperature gradient. After 60 seconds, a nozzle having a bore of 1.0 mm moving along a guide rod is reciprocated once from a low-temperature portion to a high-temperature portion at an air pressure of 0.1 MPa to a position 10 cm off the metal rod to blow off the RCS on the rod. The time requiring for one reciprocating motion of the nozzle is about 3 seconds. The temperature at a boundary line between the RCS blown off and the RCS not blown off is read out to 1° C., and it is taken as the fusion point.

—Consolidation Strength ($N/cm^2$) of Casting Mold Obtained, Using RCS for Multilayer Mold—

Using the resulting RCS for a multilayer mold, a test piece was manufactured by the multilayer molding process, and the consolidation strength of the test piece was measured. Specifically, first, a laser beam was scanned and irradiated with a scanning carbon dioxide laser irradiation device (output: 50 W) onto a sand layer (RCS layer) which was formed by scattering the resulting RCS for a multilayer mold onto a working bench and had a height of 10 mm in the range of a width of 30 mm and a length of 80 mm. This scattering of the RCS and irradiation of the laser beam were taken as a cycle, and this cycle was repeated plural times until the height of a site onto which the laser beam was irradiated reached 10 mm, thereby manufacturing 5 test pieces for measuring the consolidation strength (width: 30 mm x length: 80 mm×height: 10 mm) for each RCS for multilayer mold. Then, for each resulting test piece for measuring the consolidation strength, the consolidation strength ($N/cm^2$) was measured based on the JACT test method SM-1, and evaluated by the average value (N=5) thereof.

—Evaluation of Handling Properties in Taking Out Test Piece—

The handling properties in taking out the above-mentioned test pieces for measuring consolidation strength from the RCS layer which was not irradiated with the laser beam on the working bench (unirradiated RCS layer) were evaluated by a sensory test based on the following evaluation method and evaluation criteria. Specifically, 10 panelists took out the test pieces at room temperature (20 C.), and the handling properties at that time were evaluated based on the following criteria. Evaluation was made by an average level of obtained evaluation levels. It is meant that the higher this level, the higher the handling properties at the time of taking out.

[Evaluation Criteria]

Level 4: It is possible to extremely easily take out the test piece from the unirradiated RCS layer.

Level 3: It is possible to take out the test piece from the unirradiated RCS layer practically without trouble.

Level 2: It is difficult to take out the test piece from the unirradiated RCS layer.

Level 1: The test piece is easily disintegrated when the test piece is taken out from the unirradiated RCS layer.

—Gas Permeability of Casting Mold Obtained Using RCS for Multilayer Mold—

First, a laser beam was scanned and irradiated with a scanning carbon dioxide laser irradiation device (output: 5 kW), onto a specified site of a RCS layer which was formed by scattering the resulting RCS for a multilayer mold onto a working bench and had a height of 50 mm. This scattering of the RCS and irradiation of the laser beam were repeated plural times, thereby manufacturing a cylindrical test piece for measuring the gas permeability (diameter: 50 mm×height: 50 mm). Then, the resulting test piece was burned in a heating atmosphere of 260° C. for 1 minute, followed by cooling to ordinary temperature. The gas permeability of such a test piece after burning was measured using a gas permeability tester manufactured by Georg Fischer, based on the JACT test method M-1.

—Rate of Strength Deterioration (%) of Casting Mold Using RCS for Multilayer Mold—

A laser beam was scanned and irradiated with a scanning carbon dioxide laser irradiation device (output: 50 W), onto a specified site of an RCS layer which was formed by scattering the resulting RCS for a multilayer mold onto a working bench and had a height of 10 mm. This scattering of the RCS and irradiation of the laser beam were repeated plural times, thereby manufacturing a test piece for measuring the bending strength (width: 10 mm×length: 60 mm×height: 10 mm). Then, the resulting test piece for measuring the bending strength was burned in a heating atmosphere of 260° C. for 1 minute, followed by cooling to ordinary temperature, and the bending strength thereof (bending strength A) was measured. Further, a test piece for measuring the bending strength was completely wrapped with an aluminum foil and placed in an electric furnace with the test piece wrapped, and exposed to heat at 400° C. for 30 minutes. For the resulting test piece after heat exposure treatment, cooled it to ordinary temperature, and the bending strength thereof (bending strength B) was measured. Further, another test piece was subjected to heat exposure treatment under different conditions (450° C.×30 minutes) and after such heat exposure treatment, the bending strength thereof (bending strength B') was measured. The measurement of the bending strength of each test piece was based on the JACT test method SM-1. Further, the rate of strength deterioration (%) was calculated from the following equation, and it was evaluated that the higher the numerical value, the better the collapsibility of the casting mold after molding.

$$[\text{Rate of strength deterioration}(\%)]=\{1-[\text{bending strength } B(\text{or bending strength } B')/\text{bending strength } A]\}\times 100$$

—Amount of Pyrolytic Products Generated (mg)—

The above-mentioned test piece for measuring the bending strength was placed in a glass test tube (internal diameter: 27 mm×length: 200 mm), and then, 2.50 g of glass wool previously weighed was inserted into the vicinity of an opening of the test tube to manufacture a device for measuring the amount of pyrolytic products generated. Then, such a device was mounted in a tubular heating furnace whose inside temperature was maintained at 600° C., followed by heat exposure treatment for 6 minutes. Then, the measuring device was taken out from the furnace, and leave it to be cooled until the temperature thereof reached ordinary temperature. Thereafter, the glass wool was taken out from the measuring device, and the mass thereof was measured. The amount of pyrolytic products generated (mg) was calculated by subtracting the mass of the glass wool before heat exposure treatment from the mass of the glass wool after heat exposure treatment.

First, three kinds of phenolic novolak resins different in the ortho/para bond ratio (O/P ratio) of methylene groups were produced according to the following techniques.

—Production of Phenolic Novalak Resin A—

In a reaction vessel equipped with a thermometer, a stirrer and a condenser, 300 g of phenol, 61.4 g of 92% by mass paraformaldehyde and 0.6 g of zinc chloride were each placed. Then, the temperature in the reaction vessel was gradually elevated to a reflux temperature (98 to 102° C.) with stirring and mixing, and further maintained at the same temperature for 3 hours, thereby allowing a condensation reaction to proceed. After such a reaction, heating and concentration under reduced pressure were performed with stirring and mixing, thereby obtaining phenolic novolak resin A (resin A). The ortho/para bond ratio (O/P ratio) of resin A thus obtained was measured, and it was 1.5.

—Production of Phenolic Novalak Resin B—

In a reaction vessel equipped with a thermometer, a stirrer and a distillation unit, 300 g of phenol, 65.6 g of 92% by mass paraformaldehyde and 0.6 g of zinc acetate were each placed. Then, the temperature in the reaction vessel was elevated to about 150° C. while distilling water with stirring and mixing, thereby allowing a condensation reaction to proceed. After such a reaction, heating and concentration under reduced pressure were performed with stirring and mixing, thereby obtaining phenolic novolak resin B (resin B). The ortho/para bond ratio (O/P ratio) of resin B thus obtained was measured, and it was 2.0.

—Production of Phenolic Novalak Resin C—

In a reaction vessel equipped with a thermometer, a stirrer and a condenser, 300 g of phenol, 138.5 g of a 47% by mass aqueous formalin solution and 1.2 g of oxalic acid were each placed. Then, the temperature in the reaction vessel was gradually elevated to a reflux temperature (98 to 102° C.) with stirring and mixing, and further maintained at the same temperature for 3 hours, thereby allowing a condensation reaction to proceed. After such a reaction, heating and concentration under reduced pressure were performed with stirring and mixing, thereby obtaining phenolic novolak resin C (resin C). The O/P ratio of resin C thus obtained was measured, and it was 1.1.

Using the three kinds of phenolic novolak resin thus obtained, eleven kinds of resin-coated sand (RCS) for a multilayer mold were produced according to the following techniques.

—Production of Sample 1 and Evaluation Thereof—

In an experimental speed mixer, 7 kg of refractory particles (trade name: Cerabeads, manufactured by Itochu Ceratech Corp., grain fineness number: 130) preheated at 130 to 140° C., 210 g of phenolic novolak resin A and 21.0 g of 4,4'-diaminophenylmethane were placed and kneaded in the mixer for 60 seconds, thereby melt coating surfaces of the refractory particles with a binder composition comprising phenolic novolak resin A and 4,4'-diaminophenylmethane. Then, an aqueous hexa solution in which 31.5 g of hexamethylenetetramine as a curing agent was dissolved in 105 g of cooled water was added in the mixer. After air blast cooling, 7 g of calcium stearate was further added, thereby obtaining RCS for a multilayer mold (sample 1). For the obtained sample 1, the grain fineness number, the fusion temperature, the consolidation strength, the handling properties in taking out the test piece, the gas permeability, the rate of strength deterioration and the amount of pyrolytic products generated were evaluated or measured. The results thereof are shown in the following Table 1.

—Production of Samples 2 to 11 and Evaluation Thereof—

The production of sample 2 was performed according to the same conditions as sample 1 with the exception that the incorporating amount of phenolic novolak resin A was changed as shown in the following Table 1. Further, the production of samples 3 to 5 and 9 were performed according to the same conditions as sample 1 with the exception that phenolic novolak resins and aromatic amines shown in the following Table 1 and Table 2 were used in incorporation amounts as shown in the following Table 1 and the like, in place of the phenolic novolak resin A and/or 4,4'-diaminophenylmethane used in the production of sample 1. Further, sample 6 and sample 7 were produced according to the same conditions as sample 1 with the exception that phenolic novolak resin B was used for sample 6, that on the other hand, phenolic novolak resin B and 1,3-bis(3-aminophenoxy)benzene were used for sample 7, and that 21.0 g of potassium nitrate which is an alkali metal salt of an oxo acid, was further added during production thereof. In addition, the production of sample 8 was performed according to the same conditions as sample 1 with the exception that no aromatic amine was added at all. Further, sample 10 and sample 11 were produced according to the same conditions as with sample 1 with the exception that Cerabeads #1700 (trade name, manufactured by Itochu Ceratech Corp., grain fineness number: 170) was used as refractory particles for sample 10, that on the other hand, Cerabeads #650 (trade name, manufactured by Itochu Ceratech Corp., grain fineness number: 65) was used for sample 11, and that ones shown in the following Table 2 were used as phenolic novolak resins and aromatic amines. For each obtained sample, the grain fineness number, the fusion temperature, the consolidation strength, the handling properties in taking out the test piece, the gas permeability, the rate of strength deterioration and the amount of pyrolytic products generated were evaluated or measured. The results thereof are shown in the following Table 1 and Table 2.

TABLE 1

| RCS for Multilayer Mold | | | Sample 1 | Sample 2 | Sample 3 | Sample 4 |
|---|---|---|---|---|---|---|
| Refractory Particles | | | Cerabeads 1450 | Cerabeads 1450 | Cerabeads 1450 | Cerabeads 1450 |
| Binder Composition | Phenolic Novolak Resin | Kind (O/P Ratio) | Resin A (1.5) | Resin A (1.5) | Resin B (2.0) | Resin B (2.0) |
| | | Amount Incorporated (parts by mass)*1 | 3 | 2.5 | 2.2 | 2.2 |

TABLE 1-continued

| | | | | | | |
|---|---|---|---|---|---|---|
| | Aromatic Amine | Kind | 4,4'-Diaminodiphenyl-methane | 4,4'-Diaminodiphenyl-methane | Orthophenylene diamine | 1,3-Bis(3-amonophenoxy) benzene |
| | | Amount Incorporated (parts by mass)*2 | 10 | 10 | 10 | 10 |
| | Alkali Metal Oxo Acid Salt | Kind | — | — | — | — |
| | | Amount Incorporated (parts by mass)*2 | — | — | — | — |
| Grain Finess Number of RCS | | | 105 | 106 | 105 | 106 |
| Fusion Temperature of RCS (° C.) | | | 96 | 97 | 96 | 100 |
| Mold Performance | Consolidation Strength | | 70 | 61 | 52 | 73 |
| | Handling Properties in | | 4 | 4 | 3 | 4 |
| | Gas Permeability (cm/sec) | | 96 | 97 | 99 | 97 |
| | Rate of Strength | 400° C. × 30 min | 34 | 38 | 41 | 42 |
| | | 450° C. × 30 min | 51 | 54 | 63 | 65 |
| | Amount of Pyrolytic (600° C. × 60 min) | | 93 | 84 | 70 | 68 |

| RCS for Multilayer Mold | | | | Sample 5 | Sample 6 | Sample 7 |
|---|---|---|---|---|---|---|
| Refractory Particles | | | | Cerabeads 1450 | Cerabeads 1450 | Cerabeads 1450 |
| Binder Composition | Phenolic Novolak Resin | Kind (O/P Ratio) | | Resin B (2.0) | Resin B (2.0) | Resin B (2.0) |
| | | Amount Incorporated (parts by mass)*1 | | 2.2 | 2.2 | 2.2 |
| | Aromatic Amine | Kind | | 4,4'-Diaminodiphenyl-methane | 4,4'-Diaminodiphenyl-methane | 1,3-Bis(3-amonophenoxy) benzene |
| | | Amount Incorporated (parts by mass)*2 | | 10 | 10 | 10 |
| | Alkali Metal Oxo Acid Salt | Kind | | — | Potassium nitrate | Potassium nitrate |
| | | Amount Incorporated (parts by mass)*2 | | — | 10 | 10 |
| Grain Finess Number of RCS | | | | 105 | 105 | 105 |
| Fusion Temperature of RCS (° C.) | | | | 96 | 96 | 100 |
| Mold Performance | Consolidation Strength | | | 55 | 52 | 70 |
| | Handling Properties in | | | 4 | 4 | 4 |
| | Gas Permeability (cm/sec) | | | 98 | 98 | 98 |
| | Rate of Strength | 400° C. × 30 min | | 41 | 65 | 67 |
| | | 450° C. × 30 min | | 63 | 83 | 85 |
| | Amount of Pyrolytic (600° C. × 60 min) | | | 70 | 57 | 54 |

*1The binding ratio based on 100 parts by mass of refractory particles

*2The binding ratio based on 100 parts by mass of the phenolic novolak resin

TABLE 2

| RCS for Multilayer Mold | | | Sample 8 | Sample 9 | Sample 10 | Sample 11 |
|---|---|---|---|---|---|---|
| Refractory Particles | | | Cerabeads 1450 | Cerabeads 1450 | Cerabeads 1700 | Cerabeads 650 |
| Binder Composition | Phenolic Novolak Resin | Kind (O/P Ratio) | Resin A (1.5) | Resin C (1.1) | Resin A (1.5) | Resin A (1.5) |
| | | Amount Incorporated (parts by mass)*1 | 3.0 | 3.0 | 3.0 | 3.0 |
| | Aromatic Amine | Kind | — | Orthophenylene diamine | Orthophenylene diamine | Orthophenylene diamine |
| | | Amount Incorporated (parts by mass)*2 | — | 10 | 10 | 10 |
| Grain Fineness number of RCS | | | 107 | 105 | 158 | 71 |
| Fusion Temperature of RCS (° C.) | | | 100 | 101 | 96 | 97 |
| Mold Performance | Consolidation Strength ($N/cm^2$) | | 42 | 30 | 75 | 28 |
| | Handling Properties in Taking Out TP | | 1 | 1 | 4 | 2 |

TABLE 2-continued

| RCS for Multilayer Mold | Sample 8 | Sample 9 | Sample 10 | Sample 11 |
|---|---|---|---|---|
| Gas Permeability (cm/sec) | 96 | 95 | 42 | 112 |
| Rate of strength 400° C. × 30 min | 30 | 31 | 35 | 36 |
| Deterioration (%) 450° C. × 30 min | 50 | 51 | 51 | 55 |
| Amount of Pyrolytic Products Generated (mg) (600° C. × 60 min) | 92 | 94 | 96 | 98 |

*1The binding ratio based on 100 parts by mass of refractory particles

*2The binding ratio based on 100 parts by mass of the phenolic novolak resin

As apparent also from such results of Table 1 and Table 2, it was confirmed that the RCS for a multilayer mold (sample 1 to sample 7) in which the binder composition coating the surfaces of the refractory particles comprised the phenolic novolak resin having an ortho/para bond ratio of methylene groups of 1.5 or more and the aromatic amine and the grain fineness number thereof was within the range of 80 to 150, as in the present invention, could exhibit excellent consolidation strength compared to the RCS coated with the binder composition containing no aromatic amine (sample 8) and one coating the phenolic novolak resin which have an ortho/para bond ratio of methylene groups of less than 1.5 (sample 9), and that the handling properties in taking out the test piece (multilayer mold) from the unirradiated RCS layer were also extremely excellent. In particular, it was observed that consolidation strength of the test pieces (casting mold) obtained by using 1,3-bis(3-aminophenoxy) benzene as the aromatic amine (sample 4 and sample 7) was excellent. Accordingly, in order to develop a consolidation strength equivalent to the conventional one for the resin-coated sand for a multilayer mold of the present invention, it was observed that less amount of the phenolic novolak resin incorporated in the binder composition than the conventional one was sufficient. Therefore, there can be employed the RCS for a multilayer mold of the present invention having small amount of the phenolic novolak resin incorporated to effectively prevent molding defects caused by pyrolytic products generated during molding.

Further, it was also observed that even if the binder composition contains the phenolic novolak resin and the aromatic amine as in the present invention, the RCS for a multilayer mold having a grain fineness number exceeding 150 (sample 10) was poor in gas permeability of the resulting test piece (casting mold), although it exhibited excellent consolidation strength, and that one having a grain fineness number of less than 80 (sample 11) could not develop sufficient consolidation strength.

What is claimed is:

1. Resin-coated sand for a multilayer mold comprising refractory particles surfaces which are coated with a binder composition, wherein the binder composition comprises a phenolic novolak resin having an ortho/para bond ratio of methylene groups of 1.5 or more and an aromatic amine as indispensable constituents, and the grain fineness number thereof is from 80 to 150.

2. The resin-coated sand for a multilayer mold according to claim 1, wherein said binder composition further comprises an alkali metal salt of an oxo acid.

3. The resin-coated sand for a multilayer mold according to claim 1, wherein said aromatic amine is 1,3-bis(3-aminophenoxy)benzene.

4. The resin-coated sand for a multilayer mold according to claim 1, wherein said refractory particles are selected from the group consisting of Unimin sand, Wedron sand, zircon sand, chromite sand, spherical alumina sand, spherical ferronickel-based slag, ferrochromium-based spherical slag, a recycled material or reclaimed material thereof, and a mixture thereof.

5. The resin-coated sand for a multilayer mold according to claim 1, wherein said phenolic novolak resin is used at a ratio of 2 to 5 parts by mass based on 100 parts by mass of said refractory particles.

6. The resin-coated sand for a multilayer mold according to claim 1, wherein said aromatic amine is used at a ratio of 1 to 20 parts by mass based on 100 parts by mass of said phenolic novolak resin.

7. The resin-coated sand for a multilayer mold according to claim 1, wherein an alkali metal salt of an oxo acid is further comprised in said binder composition and used at a ratio of 1 to 50 parts by mass based on 100 parts by mass of said phenolic novolak resin.

8. The resin-coated sand for a multilayer mold according to claim 1, wherein said phenolic novolak resin is one produced by reacting an aldehyde (F) and a phenol (P) at a blending molar ratio (F/P) of the aldehyde to the phenol of 0.55 to 0.80.

9. The resin-coated sand for a multilayer mold according to claim 1, wherein said phenolic novolak resin is one obtained by reacting a phenol and an aldehyde using a divalent metal salt catalyst.

10. The resin-coated sand for a multilayer mold according to claim 1, wherein said phenolic novolak resin has a number average molecular weight of 400 to 1,000.

* * * * *